US005172827A

United States Patent [19]

Chang et al.

[11] Patent Number: 5,172,827

[45] Date of Patent: Dec. 22, 1992

[54] BEVERAGE CONTAINER

[76] Inventors: In Y. Chang; Kyung S. Kang, both of 2 Harriet Dr., Syosset, N.Y. 11791

[21] Appl. No.: 885,845

[22] Filed: May 20, 1992

[51] Int. Cl.[5] ..... B65D 47/06

[52] U.S. Cl. ..... 220/707; 220/708

[58] Field of Search ..... 220/707, 708, 710; 215/1 A, 229; 229/103.1

[56] References Cited

U.S. PATENT DOCUMENTS

| | | | |
|---|---|---|---|
| 4,582,213 | 4/1986 | Park et al. | 220/707 |
| 4,690,294 | 9/1987 | Jones | 220/707 |
| 4,712,702 | 12/1987 | Ayabousul | 220/707 |
| 4,923,084 | 5/1990 | Zorbgs | 220/707 |
| 4,948,008 | 8/1990 | Wu et al. | 220/707 |

*Primary Examiner*—Joseph Man-Fu Moy

*Attorney, Agent, or Firm*—Michael I. Kroll

[57] ABSTRACT

An improved beverage container is provided which consists of a top wall for sealing an annular open top end of a hollow housing. A first panel and a second panel are in the top wall. Tab is rotatively mounted onto the second panel, so that when the tab is tipped upwardly the first panel will bend inwardly. The tab is then pressed down flat and rotated one hundred and eighty degrees. When the tab is pulled upwardly the second panel will bend upwardly. A drinking straw is connected to the bottom surface of the second panel, so that when the second panel is bent and pulled upwardly the drinking straw will pass through the openings in the top wall to allow a person to drink from the drinking straw.

12 Claims, 2 Drawing Sheets

BEVERAGE CONTAINER

BACKGROUND OF THE INVENTION

1. Field of the Invention

The instant invention relates generally to containers for beverages and more specifically it relates to an improved beverage container.

2. Description of the Prior Art

Numerous containers for beverages have been provided in prior art that are adapted to include integral straws, which will extend up when the tops of the containers are opened for drinking. While these units may be suitable for the particular purpose to which they address, they would not be as suitable for the purposes of the present invention as heretofore described.

SUMMARY OF THE INVENTION

A primary object of the present invention is to provide an improved beverage container that will overcome the shortcomings of the prior art devices.

Another object is to provide an improved beverage container with a built-in straw that is attached to a portion of a top wall of the container, which when pulled back will raise the straw, so that the contents of the container can be consumed.

An additional object is to provide an improved beverage container in which the angle and length of the straw is adjustable, while the straw itself is retained to the top wall, so as not to be accidentally discharged and lost from the container.

Another additional object is to provide an improved beverage container that is hygienic, since a person will drink from the straw instead of placing their lips, tongue and mouth against the top wall of the container.

A further object is to provide an improved beverage container that is simple and easy to use.

A still further object is to provide an improved beverage container that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 5:
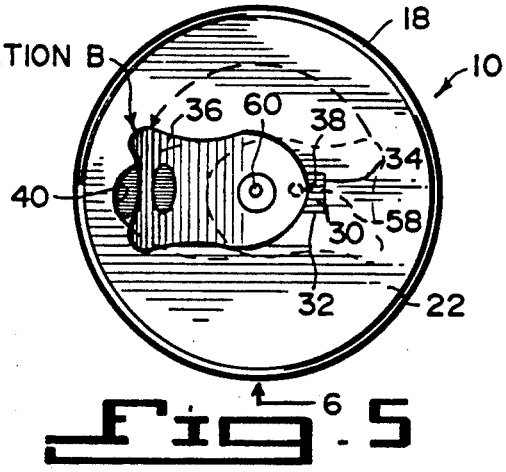
FIG. 5 is a top view taken in direction of arrow 5 in FIG. 4, showing the tab pressed down flat and rotated one hundred and eighty degrees after the first panel is depressed.

Turning now descriptively to the drawings, in which similar reference characters denote similar elements throughout the several views, the Figures illustrate an improved beverage container 10, which consists of a hollow housing 12 having a bottom wall 14, a cylindrical side wall 16 and an annular open top end 18 forming an interior beverage chamber 20. A top wall 22 is for sealing the annular open top end 18 of the hollow housing 12. A first panel 24 in the top wall 22 is defined by a first weakened seam 26 and a side fold line 28. A second panel 30 in the top wall 22 is defined by a second weakened seam 32 and an end fold line 34. In FIG. 5, a first fastener 58 consists inside of a tab 36, then a second opening 42 is pulled upwardly easily by leverage. A tab 36 is rotatively mounted to a top surface 38 of the second panel 30, so that when the tab 36 is in a first position "A" and tipped upwardly, the first panel 24 will separate from the first weakened seam 26 to bend inwardly along the side fold line 28 into the interior beverage chamber 20 to form a first opening 40 in the top wall 22. When the tab 36 is pressed down flat, rotated one hundred and eighty degrees into a second position "B" and pulled upwardly, the second panel 30 will separate from the second weakened seam 32 to bend upwardly along the end fold line 34 to form a second opening 42 in conjunction with the first opening 40 in the top wall 22.

A flexible, resilient, tubular drinking straw 44 is disposed internally within the interior beverage chamber 20 in the hollow housing 12. A structure 46 is provided for connecting an upper folded portion 48 of the drinking straw 44 to a bottom surface 50 of the second panel 30. When the second panel 30 is bent and pulled upwardly, the upper folded portion 48 of the drinking straw 44 will pass through the first opening 40 and the second opening 42 in the top wall 22 and be unfolded to allow a person to drink from the drinking straw 44.

The connecting structure 46 is a holder 52 that includes a sleeve member 54 being of a size, so that the upper folded portion 48 of the drinking straw 44 can be retained thereto. A bent arm 56 extends from the sleeve member 54, while a fastener 58, which is a common rivet, attaches a distal end of the bent arm 56 to the bottom surface 50 of the second panel 30.

The tab 36 is rotatively mounted to the top surface 38 of the second panel 30 by a second fastener 60, which is a common rivet.

The upper folded portion 48 of the drinking straw 44 includes a corrugated segment 62 and a mouthpiece 64 at a top end of the corrugated segment 62. The bottom wall 14 of the hollow housing 12 is curved inwardly towards the interior beverage chamber 20 to give extra strength thereto. A bottom end 66 of the drinking straw 44 is cut on an angle, so that a lower straight portion 68 of the drinking straw 44 will bear against the side wall 16 of the hollow housing 12 within the interior beverage camber 20.

The hollow housing 12 is fabricated from aluminum. The top wall 22 with the first panel 24 and the second panel 30 is fabricated from aluminum. The tab 36, the holder 52 and the drinking straw 44 are also fabricated from aluminum.

Other suitable materials can be utilized in fabricating the improved beverage container 10, such as tin-coated iron and the like. The drinking straw 44 can be made out of plastic, paper and the like.

Figure 1:
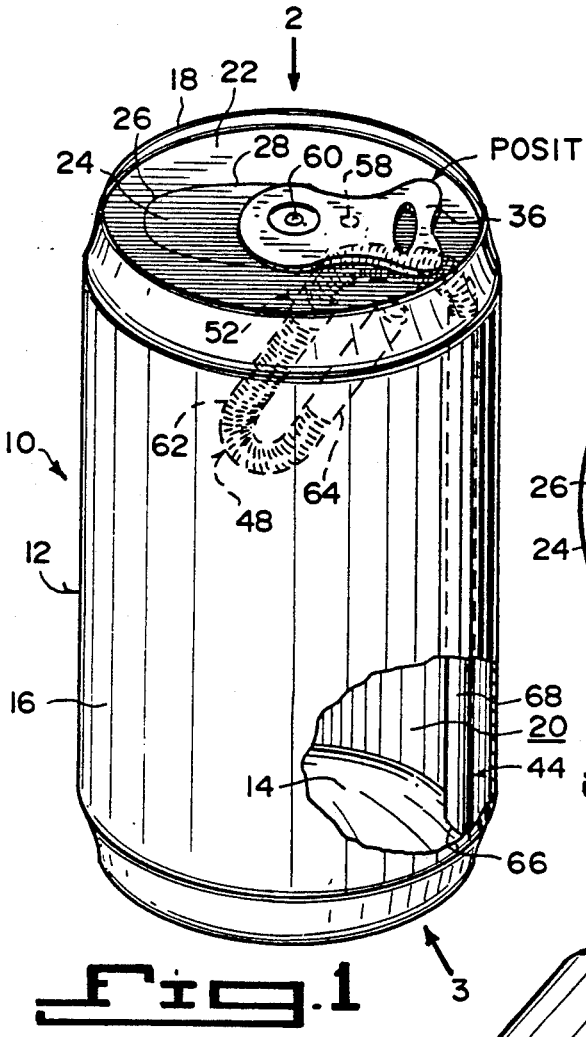
FIG. 1 is a top perspective view of the instant invention with parts broken away in a normally closed position.
Figure 2:
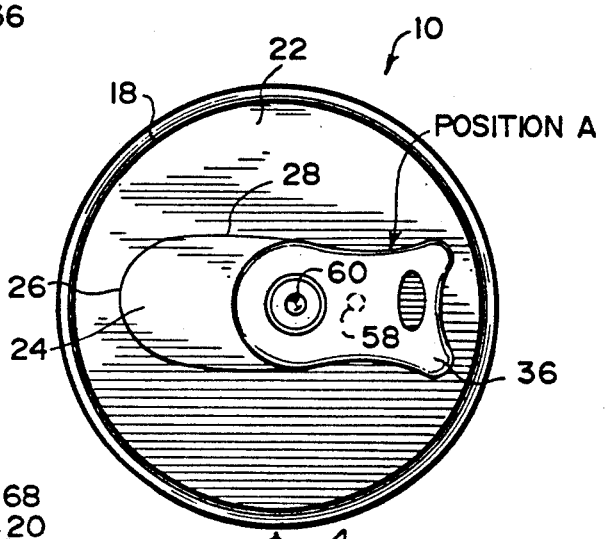
FIG. 2 is a top view taken in direction of arrow 2 in FIG. 1.
Figure 3:
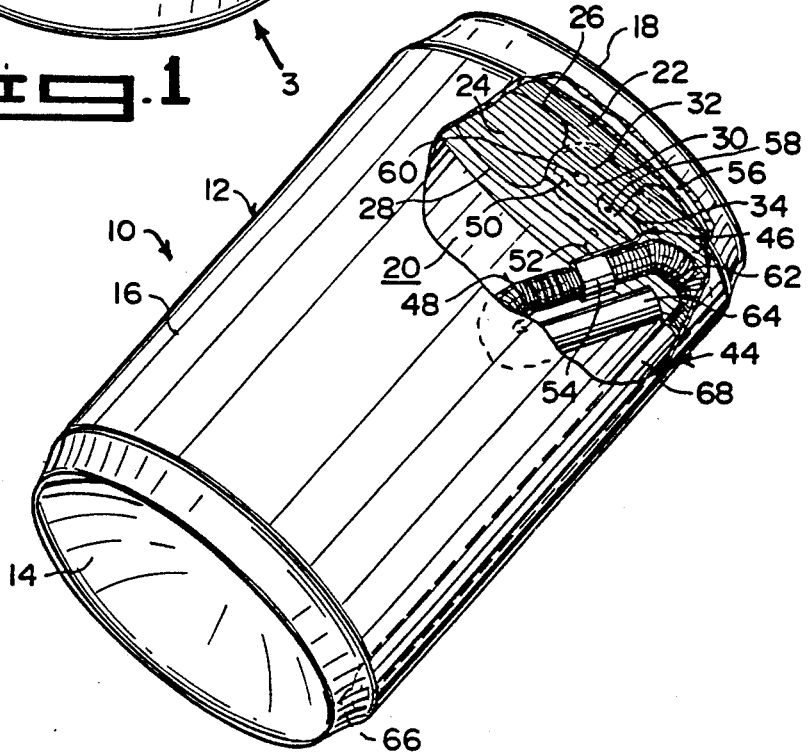
FIG. 3 is a bottom perspective view taken in direction of arrow 3 in FIG. 1 with parts broken away.
Figure 4:
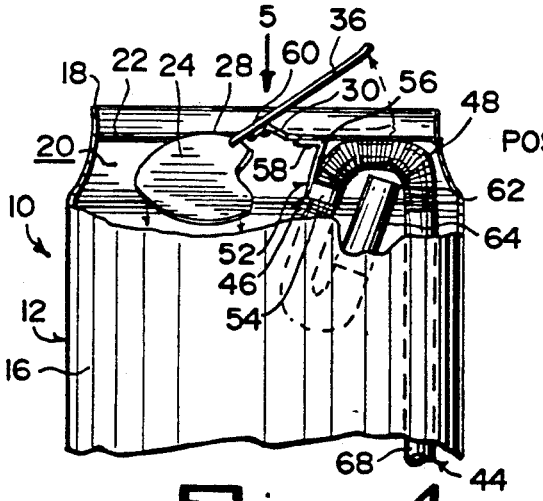
FIG. 4 is a side view taken in direction of arrow 4 in FIG. 2 with parts broken away showing the tab depressing the first panel therein.
Figure 6:
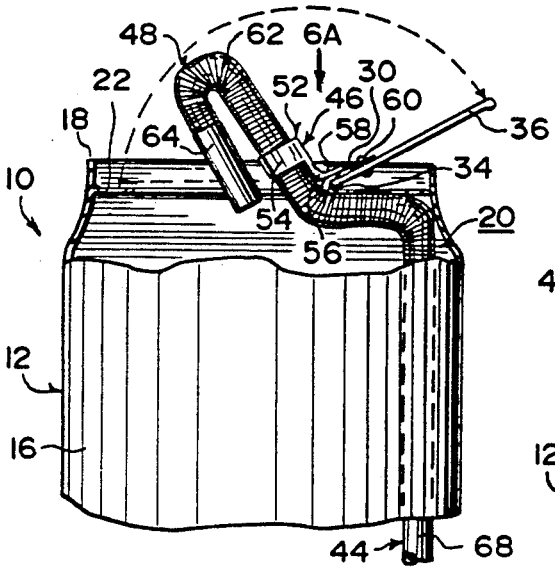
FIG. 6 is a side view taken in direction of arrow 6 in FIG. 5 with parts broken away showing the tab pulling the second panel with the holder back to raise the straw therefrom.
Figure 6A:
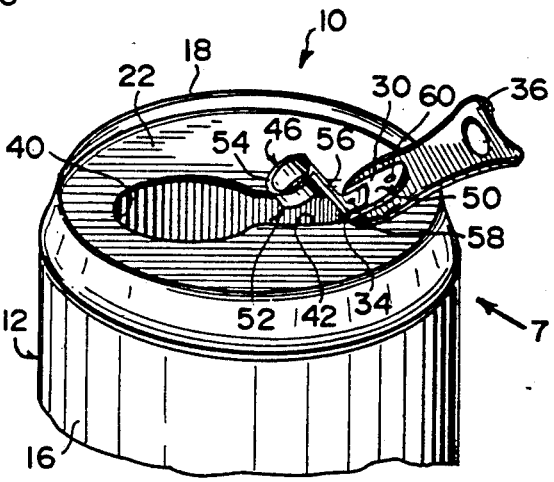
FIG. 6A is a top perspective view taken in direction of arrow 6A in FIG. 6 with parts broken away with the straw removed from the holder.
Figure 7:
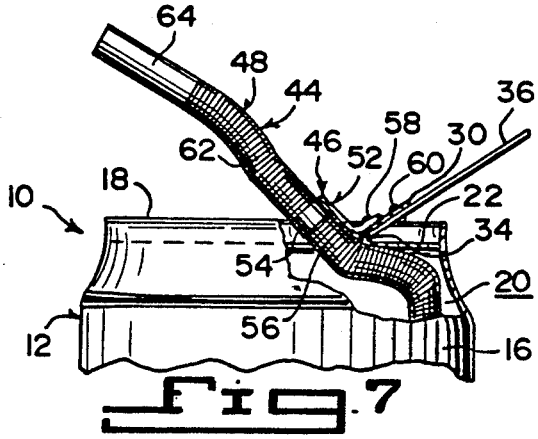
FIG. 7 is a side view taken in direction of arrow 7 in FIG. 6A with parts broken away showing the top end of the straw extended for drinking the contents therein.

To use the improved beverage container 10 the following steps should be taken:

1. Lift up the tab 36 while in position "A", so that it will tip downwardly to push the first panel 24 into the interior beverage chamber 20. (See FIG. 4.)
2. Press the tab 36 down flat.
3. Rotate the tab 36 one hundred and eighty degrees to position "B". (See FIG. 5.)
4. Pull the tab 36 upwardly so that the holder 52 will pull the upper folded portion 48 of the drinking straw 44 through the first and second openings 40 and 42 in the top wall 22. (See FIG. 6.)
5. Unfold the folded portion 48 of the drinking straw 44 by straightening the corrugated segment 62, so that the mouthpiece 64 is extended upwardly to allow the person to drink therefrom. (See FIG. 7.)

LIST OF REFERENCE NUMBERS

A: first position of 36
B: second position of 36
10: improved beverage container
12: hollow housing
14: bottom wall
16: cylindrical side wall
18: annular open top end
20: interior beverage chamber
22: top wall
24: first panel in 22
26: first weakened seam
28: side fold line
30: second panel in 22
32: second weakened seam
34: end fold line
36: tab
38: top surface of 30
40: first opening in 22
42: second opening in 22
44: drinking straw
46: connecting structure
48: upper folded portion of 44
50: bottom surface of 30
52: holder for 46
54: sleeve member
56: bent arm
58: first fastener
60: second fastener
62: corrugated segment in 48
64: mouthpiece in 48
66: bottom end of 44
68: lower straight portion of 44

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved beverage container which comprises:
a) a hollow housing having a bottom wall, a cylindrical side wall and an annular open top end forming an interior beverage chamber;
b) a top wall for sealing the annular open top end of said hollow housing;
c) a first panel in said top wall defined by a first weakened seam and a side fold line;
d) a second panel in said top wall defined by a second weakened seam and an end fold line;
e) a tab rotatively mounted to a top surface of said second panel, so that when said tab is in a first position and tipped upwardly, said first panel will separate from the first weakened seam to bend inwardly along the side fold line into the interior beverage chamber to form a first opening in said top wall, and when said tab is pressed down flat, rotated one hundred and eighty degrees into a second position and pulled upwardly, said second panel will separate from the second weakened seam to bend upwardly along the end fold line to form a second opening in conjunction with the first opening in said top wall;
f) a flexible, resilient, tubular drinking straw disposed internally within the interior beverage chamber in said hollow housing; and
g) means for connecting an upper folded portion of said drinking straw to a bottom surface of said second panel, so that when said second panel is pulled upwardly, the upper folded portion of said drinking straw will pass through the first opening and the second opening in said top wall and be unfolded to allow a person to drink from said drinking straw.

2. An improved beverage container as recited in claim 1, wherein said connecting means is a holder that includes:
a) a sleeve member being of a size, so that the upper folded portion of said drinking straw can be retained thereto;
b) a bent arm extending from said sleeve member; and
c) a fastener for attaching a distal end of said bent arm to the bottom surface of said second panel.

3. An improved beverage container as recited in claim 2, wherein said fastener is a common rivet.

4. An improved beverage container as recited in claim 3, wherein said tab is rotatively mounted to the top surface of said second panel by a second fastener.

5. An improved beverage container as recited in claim 4, wherein said second fastener is a common rivet.

6. An improved beverage container as recited in claim 5, wherein the upper folded portion of said drinking straw includes a corrugated segment and a mouthpiece at a top end of said corrugated segment.

7. An improved beverage container as recited in claim 6, further including:

a) the bottom wall of said hollow housing being curved inwardly towards the interior beverage chamber to give extra strength thereto; and b) a bottom end of said drinking straw being cut on an angle, so that a lower straight portion of said drinking straw will bear against the side wall of said hollow housing within the interior beverage chamber.

8. An improved beverage container as recited in claim 7, wherein said hollow housing is fabricated from aluminum.

9. An improved beverage container as recited in claim 8, wherein said top wall with said first panel and said second panel is fabricated from aluminum.

10. An improved beverage container as recited in claim 9, wherein said tab is fabricated from aluminum.

11. An improved beverage container as recited in claim 10, wherein said holder is fabricated from aluminum.

12. An improved beverage container as recited in claim 11, wherein said drinking straw is fabricated from aluminum.

* * * * *